US005570553A

United States Patent [19]

Balkins

[11] Patent Number: 5,570,553

[45] Date of Patent: Nov. 5, 1996

[54] ROOFING FELT PRODUCT

[76] Inventor: Thomas G. Balkins, 705 N. Hwy. 169, Plymouth, Minn. 55441

[21] Appl. No.: 390,808

[22] Filed: Feb. 15, 1995

Related U.S. Application Data

[63] Continuation of Ser. No. 96,918, Jul. 23, 1993, abandoned.

[51] Int. Cl.[6] ..... E04D 1/00

[52] U.S. Cl. ..... 52/518; 52/478; 52/748.1

[58] Field of Search ..... 52/518, 478, 748.1

[56] References Cited

U.S. PATENT DOCUMENTS

| | | | |
|---|---|---|---|
| 488,869 | 12/1892 | Cabot | 52/746 |
| 851,331 | 4/1907 | Wardell | 428/490 |
| 1,439,072 | 12/1922 | Dean | 52/478 |
| 1,593,094 | 7/1926 | Munro | 52/518 |
| 1,737,607 | 12/1929 | McDermott | 428/280 |
| 2,036,123 | 3/1936 | Dahlander | 52/746 |
| 2,151,794 | 3/1939 | Peebles . | |
| 2,351,142 | 6/1944 | Mitchell | 428/141 |
| 3,292,334 | 12/1966 | Craig | 52/516 |
| 3,333,384 | 8/1967 | Brady | 52/557 |
| 3,411,256 | 11/1968 | Best | 52/408 |
| 3,415,029 | 12/1968 | Coletta | 52/419 |
| 3,546,843 | 12/1970 | Luebs | 52/560 |
| 3,566,562 | 3/1971 | White | 52/173 |
| 4,671,036 | 6/1987 | Sullivan | 52/518 |

FOREIGN PATENT DOCUMENTS

| | | | |
|---|---|---|---|
| 3211147 | 10/1983 | Germany | 428/141 |

OTHER PUBLICATIONS

Because You Work Hard to Keep a Roof Overhead: We Keep It There Longer. For Less. Technical Data NEI F.210.

Cedar Shake and Shingle Bureau Design and Application Manual for New Roof Construction.

*Primary Examiner*—Carl D. Friedman
*Assistant Examiner*—Beth A. Aubrey
*Attorney, Agent, or Firm*—Merchant, Gould, Smith, Edell, Welter & Schmidt, P.A.

[57] ABSTRACT

An improved shake roof liner for shake shingle roofing. A one piece roof felt liner is disclosed providing an improved ice, snow and water barrier as well as reduced material installation time. A method of roofing is also disclosed.

11 Claims, 1 Drawing Sheet

ROOFING FELT PRODUCT

This is a continuation of application Ser. No. 08/096,918, filed Jul. 23, 1993, now abandoned.

FIELD OF THE INVENTION

This invention relates to a roofing felt liner, in particular, it relates to an improved one-piece felt liner to be used in roofing with shake shingles.

BACKGROUND OF THE INVENTION

This invention relates to an improved product of applying a felt liner to roofs, more particularly, the invention relates to improved felt liner to be used in the shake roofing industry. For the purpose of this invention, a "shake" can be any organic or synthetic shingle. Typically, shakes in the industry are made from cedar, pine, fir, or a compounded material. The term shake is not limited to the above and encompasses other materials used in shakes which are installed in a two, three or four-ply manner.

At present, installing a felt liner in preparation of installing shake roofs requires a two step procedure. Shake shingles require a double layer of felt as a result of often being laid as a two-ply or three-ply system. The first step requires laying an underlayment of felt on the decking of the roof. The underlayment is generally coated with a weather resistant material such as a bituminous coating. After the initial felt underlayment is secured on the roof, a shake liner is laid across the underlayment in an overlapping manner. The second layer thereafter has to be secured to the underlayment and the roof. Such installation results in a two step operation, prior to the shakes being installed.

Problems encountered with the present two layer system are numerous. One significant problem is snow, ice and water work their way underneath the shakes, the liner and onto the underlayment. Once moisture has worked its way to the underlayment, the moisture is able to find channels to the decking. These channels often are the nails or staples which extend through the underlayment and into the decking. After a period of time, the moisture is absorbed by the decking and results in rotted decking.

Prior to this invention, the method of laying a shake liner involved laying long strips transverse across the roof and securing the strips at an upper end to the underlayment and decking. This presented a problem in that the additional step of installing the shake liner, after laying the underlayment, was a tedious step and involved much time. This results in increased labor costs. Furthermore, such an additional step created an additional safety hazard in that the roofer was performing an additional task on the roof. The time minimized on the roof reduces the safety hazards to a roofer. Thus, a need exists for an easier method of laying the shake liner and underlayment on the decking prior to roofing with shake shingles. To date, there has not been a satisfactory solution to this problem.

Another problem existing in present shake roofing felt liners is the excessive material being used as a shake liner. Presently, the underlayment lays over the whole decking of the roof. The underlayment is typically a fifteen pound felt material. The shake liner, typically a fifteen pound felt, is laid in strips and extends transversely across the roof with a partial overlap. The overlapping of the shake liner results in a double layer of shake liner material on much of the roof. This double layer results in excessive use of material which increases the cost and waste of material. There is a need for an improved shake liner and underlayment which decreases this excessive use of material.

The present invention is an improved method of installing roofing felt for shake shingles as well as eliminating problems such as ice and snow getting under the shake liner. Furthermore, it reduces excess materials being used.

In recent years, there has been a steady increase in the cost of installing a shake roof. The cost of cedar shingles has risen tremendously which makes such cedar shingles prohibitive in comparison with the lower priced asphalt shingle. There is a need for a shake roofing felt liner which reduces the cost of shake roofing and can be put on the roof in a cost effective manner, thus benefitting the consumer with a lower priced option for a roofing material.

SUMMARY OF THE INVENTION

An improved shake roof felt liner, the liner comprising: (a) a felt underlayment having a top and bottom edge portion and a horizontal plane having a left and right edge portion; (b) a plurality of shake flaps extending across the underlayment, a first flap extending from proximate the left edge portion to proximate the right edge portion, the first flap extending proximate the bottom edge portion of the underlayment, the first flap having a top flap portion mechanically secured to the underlayment, a second flap extending from proximate the left edge portion to proximate the right edge portion and mechanically adhered to the underlayment, the second flap spaced closer to the top underlayment portion the first flap, the flaps defining a flap space between the first and second flap.

A method of installing shake shingles on a roof, the method comprising the steps of: (a) providing a roof having a decking; (b) providing a roof felt liner, the liner comprising: (i) a felt underlayment having a top and bottom edge portion and a horizontal plane having a left and right edge portion; (ii) a plurality of shake flaps extending across the underlayment, a first flap extending from proximate the left edge portion to proximate the right edge portion, the first flap extending proximate the bottom edge portion of the underlayment, the first flap having a top flap portion mechanically secured to the underlayment, a second flap extending from proximate the left edge portion to proximate the right edge portion and mechanically adhered to the underlayment, the second flap spaced closer to the top underlayment portion the first flap, the flaps defining a flap space between the first and second flap; (c) sizing a plurality of roof felt liners to approximate the size of the decking; (d) positioning the roof felt liners on the decking; (e) securing the roof felt liners to the decking; and (f) installing shake shingles on the roof felt liners.

DETAILED DESCRIPTION OF THE PREFERRED EMBODIMENT

Figure 1:
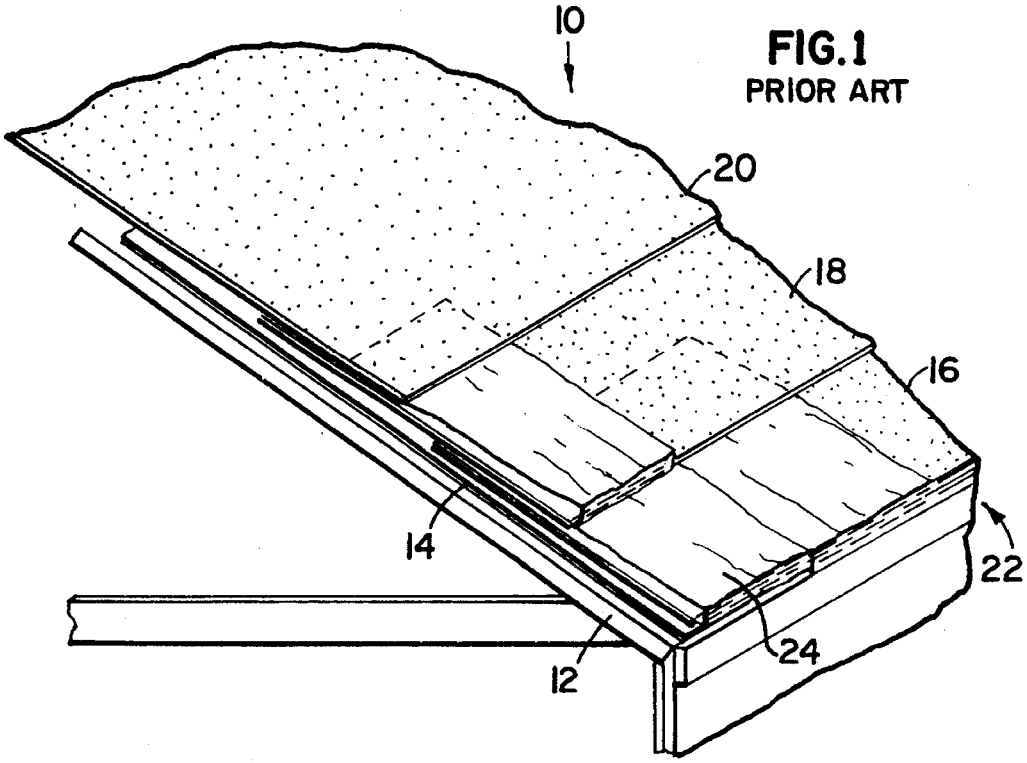
FIG. 1 PRIOR ART
FIG. 1 illustrates a perspective view of a shake roof construction of the prior art.

Referring to FIG. 1, there is shown a prior art roof construction generally referred as 10. The decking 12 has an underlayment 14 secured to it. The underlayment 14, typically is a fifteen pound felt material coated with bituminous and is secured to the decking 14 of the roof by nails or tacks.

The first shake liner 16 is thereafter rolled on and secured to the underlayment 14 of the decking 12. This process is repeated until all the shake liners are on the roof. The shake liners are typically a thirty pound felt. A cutaway of actual shakes 24 are shown atop underlayment 14. As is evident from FIG. 1, a major drawback is snow and ice can work its way under the shakes, under the shake liners and onto the underlayment 14. The resultant moisture thereafter travels down through the underlayment 14 and onto the decking 12. The path of travel often occurs via the nails or tacks which secure the underlayment 14 to the roof 12.

As is obvious from FIG. 1, there is significant overlap of the individual shake liners 16, 18 and 20 which results in a triple layer over the decking which is unnecessary. Such a process requires excessive material being used as shake liners because of the overlap. Furthermore, the individual laying of the shake liners is time consuming and increases the labor cost of the roofers in that more time spent is on the roof. Further, the more time spent on the roof, the more likely accidents such as falls will occur.

Figure 2:
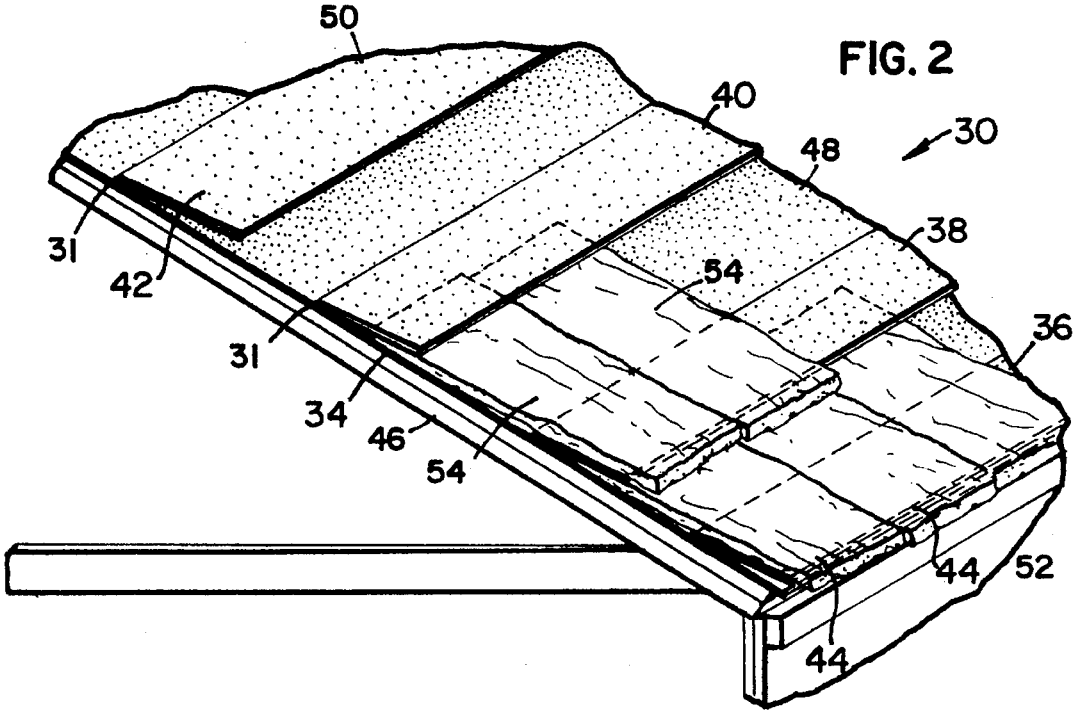
FIG. 2 illustrates a perspective view of a shake roof construction of the present invention.

In the present invention, as disclosed in FIG. 2, the shake felt liner is shown generally as 30 with decking 32 the underlayment 34 and the shake flaps 36, 38, 40 and 42. The present invention utilizes a one piece underlayment and shake liner. The present invention as situated on a roof, has a left, right, top and bottom edge portions 46, 48, 50 and 52, respectively. Shingles 54 are also identified, which are equidistant in a direction moving up the roof line in the direction of 50.

As is evident from FIG. 2, there is no overlap of the shake flaps or shake liners in the present invention. The actual shingles, shown as 44, extend from one shake flap to the next.

The shake roofing felt liner of the present invention has the shake flaps secured at points or junctions shown as 31. The shake flaps are secured to the underlayment prior to being put on the roof and are secured by adhesives typically used in industry. The shake flaps may also be sewn, heat sealed or any other means used to secure the flaps to the underlayment. The method of adhering is known to one skilled in the art.

The present invention can be sized in any manner. Preferably, the present invention is in sections 30 having dimensions of about 34–38 inches. The flaps 36, 38, 40, and 42 are about 5 inches in height. The spacing between the flaps are about 5 to 7 inches. The sections are sold as rolls. When the roofer applies the roofing felt liner of the present invention, the felt liner is merely unrolled transversely across the roof. A new section is thereafter rolled across the roof, with a side overlap of approximately 6 inches.

As is evident from comparing the amount of felt used in FIG. 1 and FIG. 2, it is apparent there is significant material savings. It is estimated the amount of material saved is about 72% over the prior felt liner, thus a cost savings of about 72%. The roofing felt liner is thereafter secured to the roof and the process of putting on the cedar shingles is immediately commenced. Thus, there is no need for the additional, time consuming step, of installing the individual shake liners.

The present invention has improved snow, ice and water barrier properties. As a result of the shake flaps being secured to the underlayment, no snow, ice or water can work its way under the layers of shake liners as is possible under the prior art. Thus, the present invention acts as a snow and ice barrier.

As will be apparent to those skilled in the art, various other modifications can be carried out for the above disclosure without departing from the spirit and scope of the invention.

What is claimed:

1. An improved shake roof, said shake roof comprising:

(a) a felt underlayment mechanically secured to a roof, said underlayment having a top and bottom edge portion and a left and right edge portion;

(b) a plurality of shake flaps extending across said underlayment, a first flap extending from proximate said left edge portion to proximate said right edge portion, said first flap extending proximate said bottom edge portion of said underlayment, said first flap having a top flap portion mechanically secured to said underlayment, a second flap extending from proximate said left edge portion to proximate said right edge portion and mechanically secured to said underlayment, said second flap spaced closer to said top edge portion of said underlayment than said first flap, said flaps defining a flap space between said first and second flaps, wherein said first and second flaps are non-overlapping in said flap space; and (c) a plurality of shakes mechanically secured to said underlayment, each shake having a top edge overlapped by one of said plurality of shake flaps, a bottom edge of a first row of shakes extending partially below said bottom felt underlayment edge, a bottom edge of a second row of shakes positioned further up the roof line, the bottom edge of said second row of shakes being substantially equidistant from said bottom edge of said first shakes.

2. The shake roof of claim 1 wherein said mechanical securing is accomplished by an adhesive.

3. The shake roof of claim 1 wherein said mechanical securing is accomplished by stitching.

4. The shake roof of claim 1 wherein said mechanical securing is accomplished by heat sealing.

5. The shake roof of claim 1 wherein said plurality of shake flaps extend all the way to proximate the top edge portion of said underlayment.

6. The shake roof of claim 1 wherein said underlayment is about a 15 pound felt.

7. The shake roof of claim 1 wherein said shake flap is about a 15 pound felt.

8. The shake roof of claim 1 wherein said flaps are approximately 5 inches tall.

9. The shake roof of claim 1 wherein said space is approximately 5 inches.

10. The shake roof of claim 1 wherein said shake is selected from the group consisting of cedar, pine and fir.

11. The shake roof of claim 1 wherein said underlayment is approximately 34–42 inches in size.

* * * * *